US006994147B2

(12) United States Patent
Saha et al.

(10) Patent No.: US 6,994,147 B2
(45) Date of Patent: Feb. 7, 2006

(54) SEMI-SOLID METAL CASTING PROCESS OF HYPEREUTECTIC ALUMINUM ALLOYS

(75) Inventors: Deepak Saha, Worcester, MA (US); Diran Apelian, West Boylston, MA (US); Mark A. Musser, Osceola, IN (US); Dayne Killingsworth, South Bend, IN (US); Zach Brown, Kalamazoo, MI (US)

(73) Assignee: SPX Corporation, Charlotte, NC (US)

( * ) Notice: Subject to any disclaimer, the term of this patent is extended or adjusted under 35 U.S.C. 154(b) by 297 days.

(21) Appl. No.: 10/619,143

(22) Filed: Jul. 15, 2003

(65) Prior Publication Data

US 2005/0011626 A1 Jan. 20, 2005

(51) Int. Cl.
*B22D 17/04* (2006.01)

(52) U.S. Cl. ..... 164/113; 164/900

(58) Field of Classification Search ..... 164/113, 164/900, 312

See application file for complete search history.

(56) References Cited

U.S. PATENT DOCUMENTS

| | | | | | |
|---|---|---|---|---|---|
| 4,865,808 | A | * | 9/1989 | Ichikawa et al. | 428/548 |
| 4,917,359 | A | * | 4/1990 | Ichikawa et al. | 266/208 |
| 5,009,844 | A | * | 4/1991 | Laxmanan | 148/95 |
| 5,355,930 | A | | 10/1994 | Donahue et al. | 164/34 |
| 5,571,346 | A | * | 11/1996 | Bergsma | 148/550 |
| 5,758,707 | A | * | 6/1998 | Jung et al. | 164/4.1 |
| 5,787,959 | A | * | 8/1998 | Laxmanan et al. | 164/66.1 |
| 5,968,292 | A | * | 10/1999 | Bergsma | 148/437 |
| 6,200,396 | B1 | | 3/2001 | Laslaz et al. | 148/437 |
| 6,427,754 | B1 | * | 8/2002 | Ozcan | 164/95 |

FOREIGN PATENT DOCUMENTS

| | | |
|---|---|---|
| JP | 56146845 | 11/1981 |
| SU | 1089159 | 4/1984 |
| WO | WO 00/43152 | 7/2000 |

OTHER PUBLICATIONS

Tatsuya Ohmi, et al., "Effect of Casting Condition on Refinement of Primary Crystals in Hypereutectic Al–Si Alloy Ingots Produced by Duplex Casting Process", J. Japan Inst. Metals, vol. 56, No. 9, 1992, pp. 1064–1071.

Tatsuya Ohmi, et al., "Control of Primary Silicon Crystal Size of Semi–Solid Hypereutectic Al–Si Alloy by Slurry–Melt Mixing Process", J. Japan Inst. Metals, vol. 58, No. 11, 1994, pp. 1311–1317.

* cited by examiner

*Primary Examiner*—Tom Dunn
*Assistant Examiner*—Len Tran
(74) *Attorney, Agent, or Firm*—Baker & Hostetler LLP

(57) ABSTRACT

A method for the refining of primary silicon in hypereutectic alloys by mixing at least two hypereutectic alloys into a solid/semi-solid hypereutectic slurry is described. The method provides control of the morphology, size, and distribution of primary Si in a hypereutectic Al—Si casting by mixing a hypereutectic Al—Si liquid with solid hypereutectic Al—Si particles. The invention enables SSM processing of hypereutectic Al—Si alloys.

16 Claims, 3 Drawing Sheets

SEMI-SOLID METAL CASTING PROCESS OF HYPEREUTECTIC ALUMINUM ALLOYS

FIELD OF THE INVENTION

The present invention relates generally to a process of casting metal alloys. More particularly, the present invention relates to a method of semi-solid metal casting of aluminum-silicon alloys.

BACKGROUND OF THE INVENTION

Conventional casting methods such as die casting, gravity permanent mold casting, and squeeze casting have long been used for Aluminum-Silicon (Al—Si) alloys. However, where semi-solid metal (SSM) casting of Al—Si alloy materials has been involved, the conventional methods have not been employed successfully to date. Rheocasting and thixocasting are casting methods that were developed in an attempt to convert conventional casting means to SSM casting. However, these SSM methods require additional retrofitting to conventional casting machinery and challenges remain in the ability to manipulate the microstructures of primary Al and/or Si in the cast part for improving cast performance.

Accordingly, it is desirable to provide a method of casting SSM hypereutectic Al—Si alloys utilizing both conventional and rheocasting means that can impart desirable mechanical properties. In particular, there is a need for a process to control the nucleation and growth of primary Si particles in hypereutectic Al—Si alloys. Further still, it is desirable to provide a method of producing products with Al—Si alloy castings by conventional or rheocasting techniques wherein the temperature of the semi-solid slurry can be controlled.

SUMMARY OF THE INVENTION

The foregoing needs are met, to an extent, by the present invention, wherein according to one embodiment, an SSM casting process is provided that generates products with Al—Si alloy castings by conventional or rheocasting techniques wherein the temperature and the final morphology of the primary Si of the product can be controlled.

In accordance with one embodiment of the present invention an SSM casting process is provided comprising heating a first Al—Si hypereutectic alloy to a first temperature, combining the heated alloy with a second Al—Si hypereutectic alloy having a second temperature to form a semi-solid slurry, cooling the combined first and second Al—Si hypereutectic alloys for a determined length of time, and then casting the semi-solid slurry. The length of cooling time can be zero. The alloys may be of the same or different chemical composition. The alloys may also be heated to the same or different temperatures.

In accordance with another embodiment of the present invention an SSM casting process is provided wherein the temperature of a first Al—Si hypereutectic alloy is higher than the temperature of a second Al—Si hypereutectic alloy such that there is a difference in temperature between the first and second Al—Si hypereutectic alloys. The difference in temperature may be chosen to achieve a determined rate of cooling which may allow control of primary Si particle size in the final cast product. In some embodiments, hypereutectic Al—Si cast products may have Si particles with an average diameter of less than about 40 microns. The difference in temperature may also be chosen to achieve a faster rate of cooling of the hotter alloy as compared to heating the hotter Al—Si hypereutectic alloy and allowing the hotter alloy to cool independently at room temperature.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
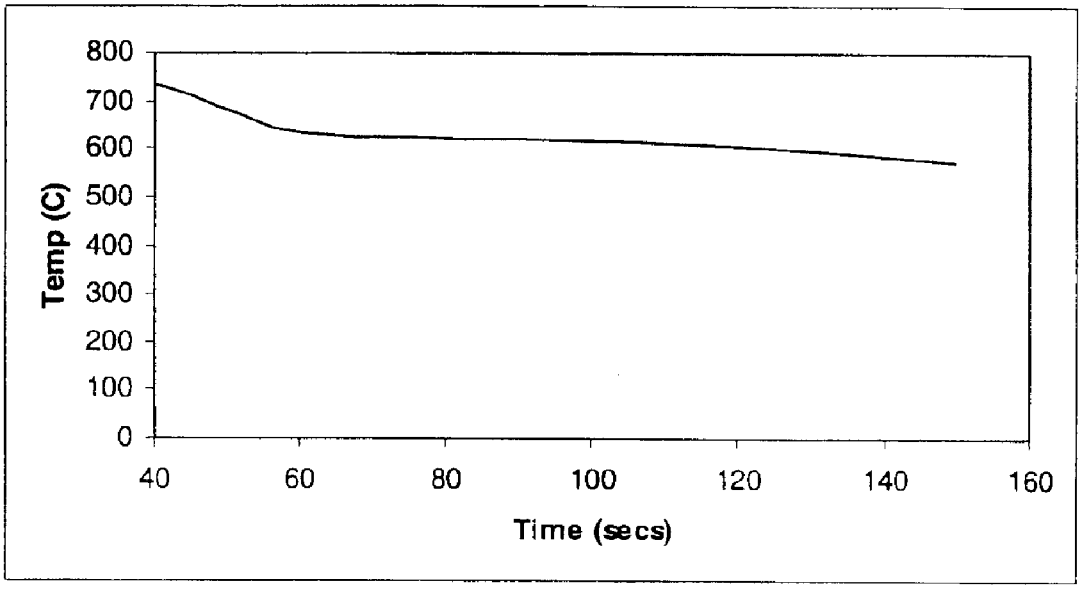
FIG. 1 is a temperature vs. time plot showing the rate of cooling of Liquid 390 alloy melt upon the addition of 390 alloy chips to the melt.

The present invention provides a method for controlling the composition, temperature and microstructure of hypereutectic Al—Si alloys via SSM casting in an attempt to control the mechanical properties of the final cast product. Generally, this is accomplished by mixing at least two hypereutectic Al—Si alloys. By definition, aluminum alloys with up to but less than about 11.7 weight percent Si are defined "hypoeutectic", whereas those with greater than about 11.7 weight percent Si are defined "hypereutectic". In all instances, the term "about" has been incorporated in this disclosure to account for the inherent inaccuracies associated with measuring chemical weights and measurements known and present in the art.

The metallic composition of alloys used in current methods for SSM casting is limited to the availability and composition of the starting materials. In contrast, according to the present invention, a broad range of metallic compositions are achievable from the same starting materials because the combination of hypereutectic alloys into a singular hypereutectic alloy allows for the manipulation of the final concentration of Si in the Al—Si alloy by controlling the composition and mass of the starting materials or semi-solid slurries.

Mixed hypereutectic alloy compositions can be formed by combining two or more aluminum alloys comprising greater than about 11.7 percent Si in aluminum. In one embodiment, two Al—Si alloys are combined to form a mixed hypereutectic alloy. It will be noted that one of the starting materials need not be an Al—Si alloy, but alternatively, purely Aluminum or purely Silicon. In yet other embodiments, combinations of two or more hypereutectic alloys with the same Al—Si chemistry (i.e., same weight percent Si) are disclosed herein. One example of a hypereutectic alloy is a 390 alloy (commercially available alloy of approximately 16%–18% Si by weight) known in the art.

In addition to imparting unique physical properties to the end product, the concentration of Si in aluminum has consequences in the phase profile of any given alloy at any given temperature. For example, hypereutectic Al—Si alloys begin to develop large Si particles as they begin to cool below the liquidus and into the SSM range. In a preferred embodiment, the instant invention teaches a method of mixing two Al—Si alloys at different temperatures together so that the amount of time the mixture spends in the transitional semi-solid phase is minimized, thereby reducing the time in which large Si particles may develop.

Temperature control of the alloys can be achieved by mixing two or more hypereutectic alloys as in the present invention. Generally, one alloy is heated to a liquid state and then mixed with an alloy of cooler temperature to bring the combined melt within the SSM range. The cooler alloy may serve as a heat sink when the hotter alloy is combined therewith, thus bringing the combined alloy mixture into the semi-solid regime more rapidly than using conventional coolers or air cooling. In some embodiments, one or more of the hypereutectic alloys is maintained in a solid state. Preferably, the cooler or solid alloy is generally poured into the hotter or liquid hypereutectic alloy; however, it is also possible to add the hotter alloy to the cooler alloy. Solid phase alloys may be presented in any form known in the art, which include, but are not limited to, grains, chips, and/or pellets.

In one embodiment, the alloys may be heated typically to a range of from about 600° C. to about 850° C. In yet other embodiments, one of the alloys to be combined may not be heated at all, e.g., it may be used at ambient room temperature.

In one embodiment of the invention, a cooler alloy is combined with a hotter alloy, and preferably, the hotter alloy is raised to about 760° C. and the cooler alloy is left at ambient or room temperature. This large temperature gradient allows for a quicker extraction of heat from the hotter parent alloy than with conventional coolers and decreases the time necessary for the liquid alloy to drop in temperature to a semi-solid/slurry processing temperature. Such rapid nucleation of the primary Si phase is thought to result in a more homogeneous microstructure throughout the material.

FIG. 1 is a plot of the temperature of a liquid 390 alloy as a function of time. 390 alloy was heated to 760° C. at which time 390 alloy chips at room temperature were added. In this embodiment, 100 grams of liquid melt were added to 30 grams of chips (about 23% by weight). In other embodiments, the weight percentage of the cooler alloy to be added may range from about 20% to about 30% by weight of the hotter alloy. Addition of the 390 alloy chips resulted in rapid cooling of the melt, dropping the temperature over 100° C. in the first minute and about 170° C. in about 1.8 minutes.

In this manner, the current invention can enable SSM casting of hypereutectic alloys via the rheocast method without secondary processing equipment such as external cooling mechanisms, or induction heating apparatuses. For example, in one embodiment, current squeeze casting processes can now be converted to an SSM casting process at significantly reduced retrofitting costs by using the teachings described herein to cool hypereutectic Al—Si alloys to the SSM range rather than with additional above-mentioned apparatuses.

Figure 2:
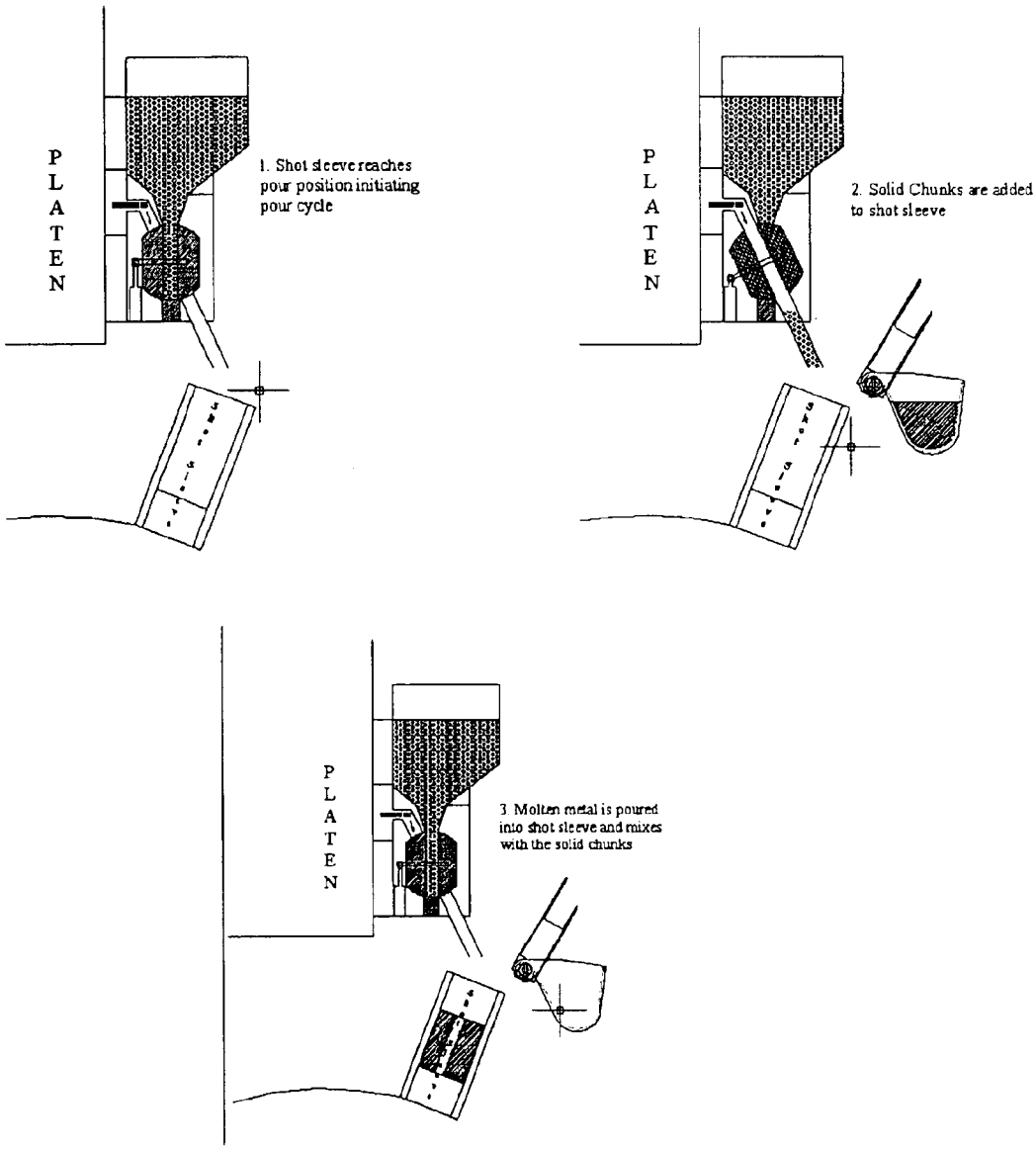
FIG. 2 is a graphic representation of one embodiment of how the inventive process can be performed.

FIG. 2 is a graphic representation of a squeeze casting process in accordance with one embodiment of the invention used for squeeze casting. Persons of ordinary skill will recognize that alternate embodiments are also possible within the scope and spirit of the present invention, and that therefore, the invention should not limited to the details of the construction or the arrangement of the components described herein.

According to the embodiment in FIG. 2, a shot sleeve on a casting device first reaches a pour position thereupon initiating a pour cycle. The shot sleeve is a receptacle to contain measured amounts of liquid/slurry material to be later transferred into a die cavity. Solid chunks of the cooler hypereutectic alloy are added to the shot sleeve. Thereafter, molten metal of the hotter hypereutectic alloy is poured into the shot sleeve and mixed with the solid chunks. The combination in this embodiment leads to rapid dissolution of the solid material into the molten metal and in so doing, drops the initial temperature of the molten metal. Once in the SSM range, the slurry is then injected, by any one of a variety of methods known in the art, into the die cavity and proceeds to be cast.

Figure 3:
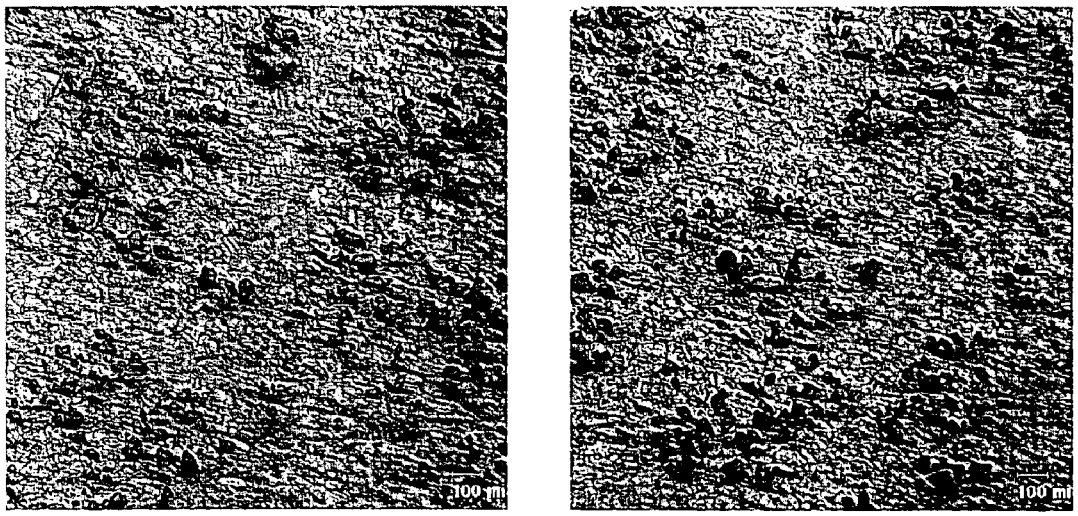
FIG. 3 shows a representative microstructure (low magnification) from castings produced by the process of FIG. 2.

As mentioned above, the growth of Si particles in the semi-solid phase may be directly correlated to the initial temperature and the time of cooling of the alloy before casting. The longer an alloy remains in the semi-solid phase, the likelihood for undesirable growth of large Si particles is increased. Alternatively, shortening the time an alloy spends in the SSM phase before casting minimizes the growth of large Si particles by maximizing the number of nucleating events, producing more Si particles of smaller size. FIG. 3 is representative of the microstructure of products cast by the inventive steps described.

FIG. 3 shows the microstructure of cast alloys after they have been quenched. In the particular embodiment presented, a 390 alloy was heated to 760° C. and then combined with 390 alloy chips at room temperature. The 390 alloy chips were about 0.25 $in^3$ in average size. The combined liquid mixture cooled to 590° C. by virtue of mixing of the two alloys of different temperature, before it was finally quenched. Cross sections of the cast product were taken and microanalysis of the various sections of the casting demonstrated that the primary Si particles were relatively evenly distributed with minimal aggregate formation. The Si is seen as the dark colored particles in the microstructure, and the background is the eutectic (i.e., a mixture of Al—Si). The primary Si particles shown range in size from about 20 microns to about 50 microns in diameter.

Figure 4:
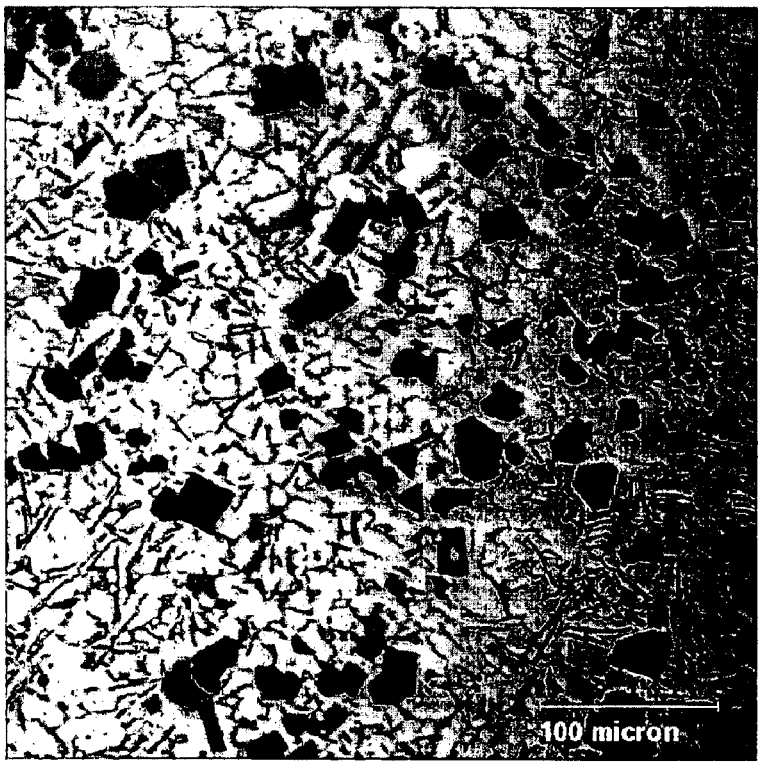
FIG. 4 shows a representative microstructure (high magnification) from castings produced by the process of FIG. 2.

FIG. 4 shows the morphology of primary Si in the same casting as in FIG. 3 at a higher magnification. The final primary Si particles averaged less than about 40 microns in the final microstructure.

A more rapid drop in temperature results in greater nucleating events than if the temperature is dropped gradually. This has the desirable effect of generating multiple Si particles that are smaller in size (width and length), but also generally uniformly distributed through out the alloy. The even distribution of the Si particles, as seen in FIGS. 3 and 4, allows for better prediction of mechanical properties with less likelihood of mechanical failure which in effect limit the average growth of the Si particles.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for semi-solid metal casting, comprising:

providing a first aluminum-silicon hypereutectic alloy and a second aluminum-silicon hypereutectic alloy;

heating the first alloy to a liquid state;

combining the first alloy and the second alloy to form a semi-solid metal;

increasing nucleation events of primary Silicon particles in the semi-solid metal by rapidly cooling the semi-solid metal by combining the first and second alloys at different temperatures and by decreasing the time the semi-solid metal remains in the semi-solid state before casting; and casting the semi-solid metal in a cast machine.

2. The method of claim 1, wherein the primary Silicon particles have an average diameter of between about 20 microns to about 50 microns.

3. The method of claim 2, wherein the primary Silicon particles have an average diameter of less than about 40 microns.

4. The method claim 1, wherein the first and second aluminum-silicon hypereutectic alloys are of the same composition.

5. The method of claim 1, further comprising:

providing a third aluminum-silicon hypereutectic alloy; and combining the third alloy with the first and second alloys.

6. The method of claim 1, wherein the second alloy is at room temperature before being combined with the first alloy.

7. The method of claim 1, further comprising heating the second alloy to a liquid state.

8. The method of claim 7, wherein the first alloy is heated to a higher temperature than the second alloy.

9. The method of claim 1, wherein the first alloy is heated to a temperature of about 600° C. to about 850° C.

10. The method of claim 9, wherein the first alloy is heated to a temperature of about 630° C. to about 800° C.

11. The method of claim 1, wherein the first alloy is heated to a temperature of about 760° C.

12. The method of claim 7, wherein the second alloy is heated to a temperature from about 22° C. to about 640° C.

13. The method of claim 1, wherein the first and second alloys are a 390 alloy.

14. The method of claim 7, wherein the second alloy is heated to a temperature of about 600° C. to about 850° C.

15. The method of claim 14, wherein the second alloy is heated to a temperature of about 630° C. to about 800° C.

16. The method of claim 7, wherein the second alloy is heated to a temperature of about 760° C.

* * * * *